US005695312A

United States Patent [19]

Kelly

[11] Patent Number: 5,695,312

[45] **Date of Patent: *Dec. 9, 1997**

[54] METHOD AND APPARATUS FOR STACKING GOLF BALLS

[76] Inventor: Greg Kelly, 1900 D Riverwood La., Roswell, Ga. 30075

[ * ] Notice: The term of this patent shall not extend beyond the expiration date of Pat. No. 5,551,832.

[21] Appl. No.: 679,736

[22] Filed: Jul. 12, 1996

Related U.S. Application Data

[63] Continuation-in-part of Ser. No. 514,823, Aug. 14, 1995, Pat. No. 5,551,832.

[51] Int. Cl.[6] ..... B65B 35/50; A47F 7/00

[52] U.S. Cl. ..... 414/788; 414/786; 206/315.9; 206/499; 211/14; 473/131; 473/409

[58] Field of Search ..... 414/799, 786, 414/788, 788.9, 922; 206/315.9, 499, 563; 211/14; 53/255, 397, 473

[56] References Cited

U.S. PATENT DOCUMENTS

| | | | |
|---|---|---|---|
| 1,201,441 | 10/1916 | Clinger | 211/14 |
| 3,139,185 | 6/1964 | Wentz | 211/14 |
| 3,302,843 | 2/1967 | Sheehan | 206/315.9 |
| 4,103,773 | 8/1978 | Haber | 211/14 |
| 4,892,197 | 1/1990 | Slattery et al. | 211/14 |
| 5,184,735 | 2/1993 | Black | 211/14 |
| 5,381,895 | 1/1995 | Thomsen | 206/315.9 |

*Primary Examiner*—Karen B. Merritt
*Assistant Examiner*—Douglas Hess
*Attorney, Agent, or Firm*—Cobrin Gittes & Samuel; Robert J. Hess, Esq.

[57] ABSTRACT

A method and apparatus for stacking golf balls in an aesthetically pleasing manner includes the use of a invertible form having a cavity therein. By placing golf balls within the cavity, the form may be inverted and the balls therein allowed to assume a stacked configuration atop a supporting base, which can be maintained after the form is lifted upwardly and away from the stack/base combination.

11 Claims, 3 Drawing Sheets

METHOD AND APPARATUS FOR STACKING GOLF BALLS

CROSS REFERENCE TO CO-PENDING PATENT APPLICATIONS

This is a continuation-in-Part of U.S. Ser. No. 08/514,823, filed Aug. 14, 1995, now issued as U.S. Pat. No. 5,551,832.

TECHNICAL FIELD

The present invention relates in general to golfing, and particularly relates to a method and apparatus for stacking golf balls in an aesthetically pleasing manner such that said golf balls may be selectively removed from a pyramidic golf ball stack without significantly disrupting the stack.

BACKGROUND OF THE INVENTION

The present invention relates to golf balls, and particularly relates to a method and apparatus for grouping and stacking golf balls in an aesthetically pleasing manner to facilitate their selective removal therefrom.

In the field of golfing, it is often desirable to provide one or more stacks of golf balls in order to allow the golf balls to be selectively removed from the stack. For example, at golf driving ranges, it is often desired to provide a group of such golf balls at each booth, in order to allow a golfer practicing his or her swing to repeatedly pick a golf ball from the group of balls, place the ball on a tee, and hit it.

It is presently known to group such golf balls by use of a wire or other suitable basket, with the balls simply being placed in a relatively unorganized manner within the basket, and either dumped or manually removed one-by-one therefrom.

It is also known to arrange such golf balls in groups by hand-stacking them into "pyramids", with a person manually stacking golf balls upon a suitable base and stacking additional golf balls level-by-level upon the previously-positioned level of golf balls. Although such a pyramid presentation of golf balls, it can become somewhat time-consuming to achieve due to its labor-intensive nature.

Therefore, it may be seen that there is a need in the art to provide a method and apparatus for quickly and easily stacking golf balls in an aesthetically pleasing manner, which allows for such stacking without excessive labor use.

SUMMARY OF THE INVENTION

The present invention overcomes deficiencies in the prior art by providing a method and apparatus for stacking golf balls in an aesthetically pleasing manner, which is cost and labor-efficient to use and operate.

Generally described, the present invention relates to a method of placing a plurality of golf balls within an inverted form, placing an inverted base atop said inverted form, inverting the entire assembly such that the plurality of golf balls is stacked upon the now-upright base, and withdrawing the now-upright form such that a pyramidic stack of golf balls is left remaining atop the base. The present invention also relates to an apparatus for facilitating the above method.

Therefore, it is an object of the present invention to provide a method and apparatus for stacking golf balls in an aesthetically pleasing manner.

It is a further object of the present invention to provide a method and apparatus for stacking golf balls which is simple in operation.

It is a further object of the present invention to provide a method and apparatus for stacking golf balls which is cost-effective to manufacture.

Other objects, features, and advantages of the present invention will become apparent upon reading the following detailed description of the preferred embodiment of the invention when taken in conjunction with the drawing and the appended claims.

DETAILED DESCRIPTION OF THE PREFERRED EMBODIMENT

Figure 1:
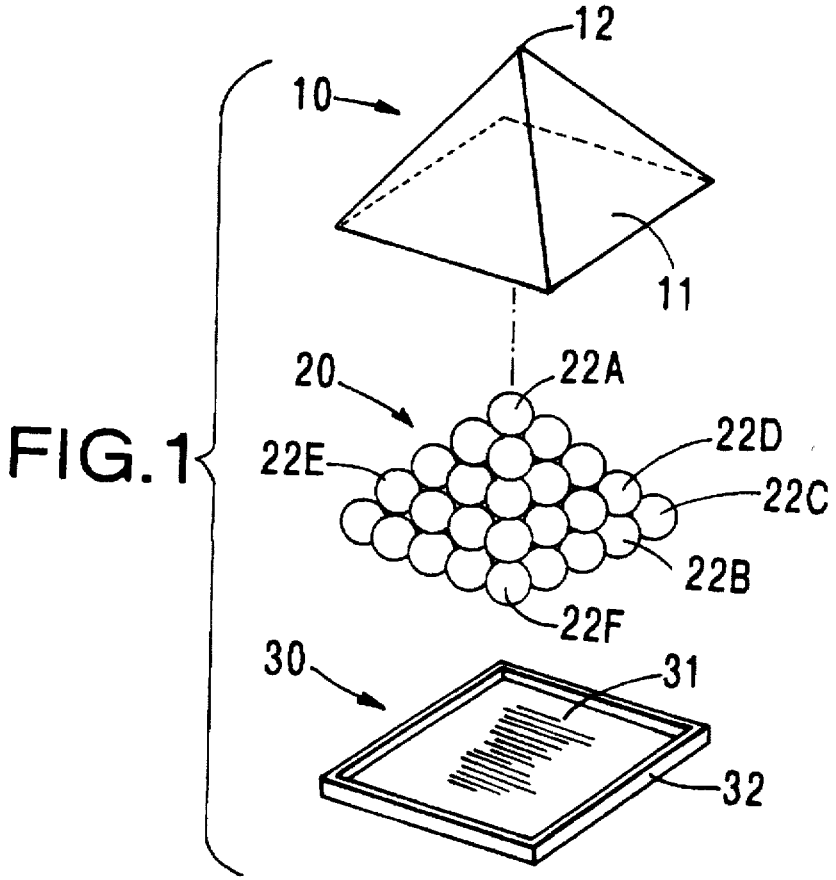
FIG. 1 is an exploded illustrative pictorial view of a stacking form 10 (with a handle not shown), a group 20 of stacked balls, and a base 30.
Figure 2:
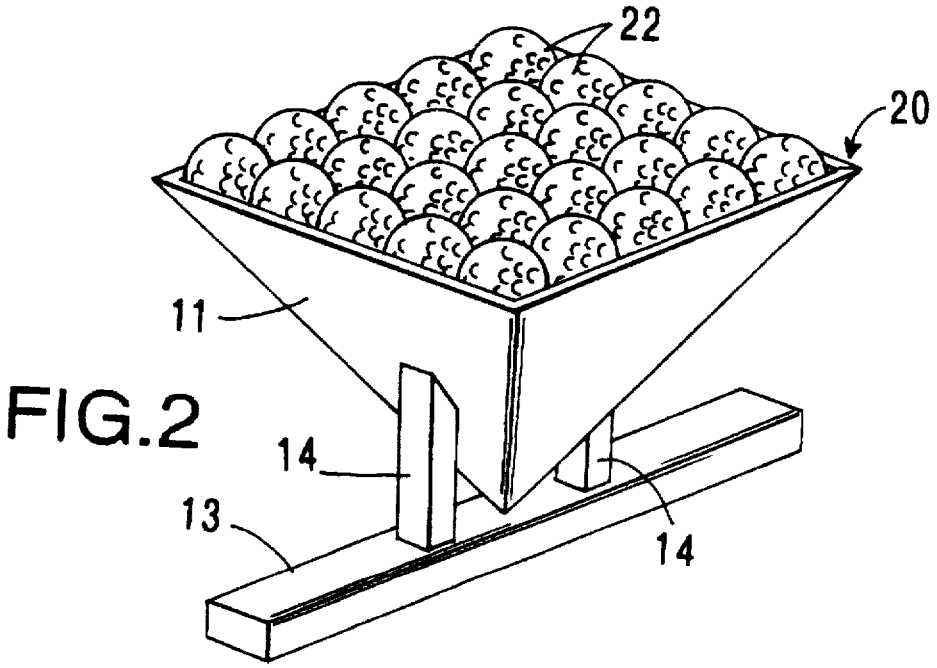
FIG. 2 is a pictorial view of a stacking form according to the present invention (with a handle 13 shown) with a group of golf balls placed therein.
Figure 3:
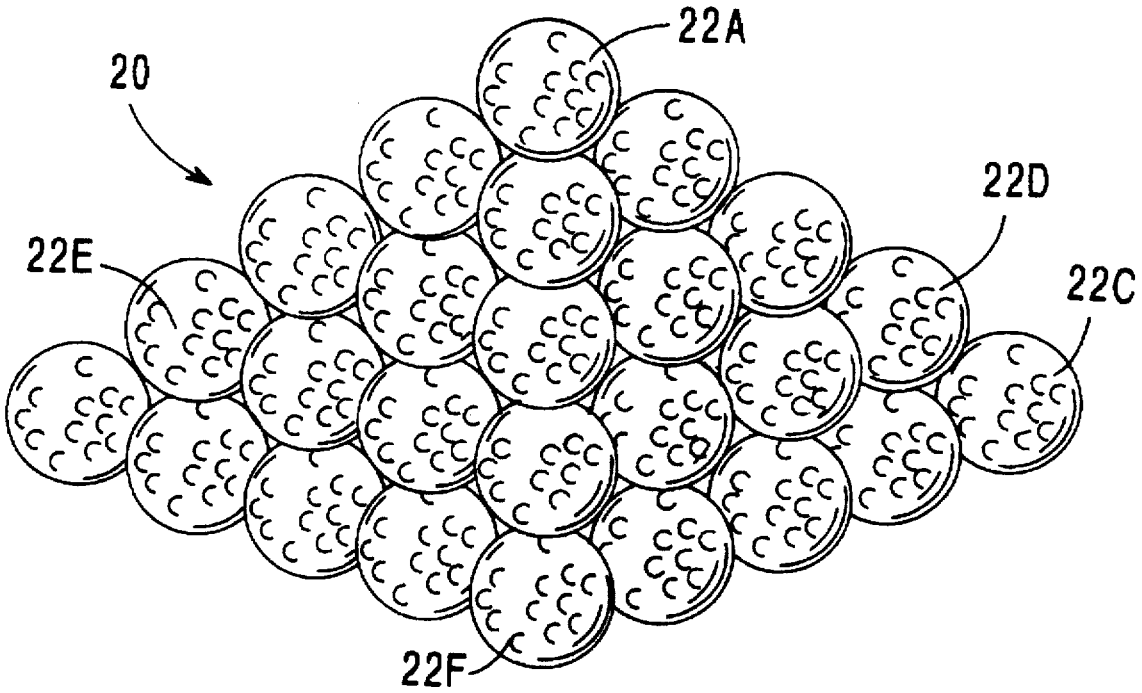
FIG. 3 illustrates a stack of golf balls provided under the present invention, with a topmost "peak" ball designated as 22A, certain golf balls on the lowest, "first" level designated as 22F and 22C, and golf balls on the "second" level designated at 22E and 22D.
Figure 4:
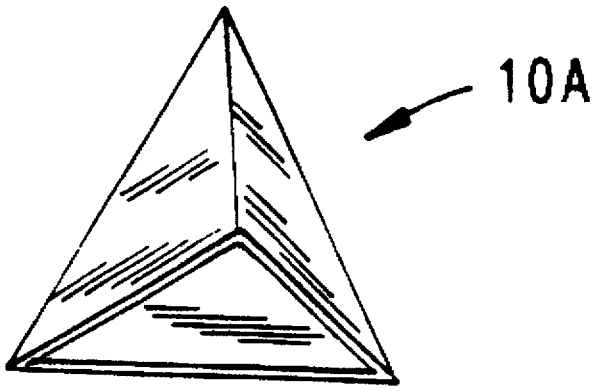
FIG. 4 illustrates an invertible stacking forming member of triangular shape.

Reference is first generally made to FIGS. 1, 2, and 3, in which like numerals designate like elements throughout the illustrated views.

FIG. 1 illustrates the cooperation of an invertible forming member 10, a stack of golf balls 20, and a supporting base member 30. As will be discussed in further detail, golf balls placed within the invertible forming member 10 can be inverted along with the forming member such that they rest upon the supporting base 30. Preferably, the balls remain in the stacked group 20 shown in FIG. 1 even after the forming member 10 is then withdrawn upwardly and is no longer in contact with the group 20 of golf balls.

As shown in FIG. 1, the base 30 includes a planar member 31 having a peripheral edge 32 attached thereto configured to provide lateral peripheral support to the lowermost level of golf balls.

Referring now to FIG. 2, it may be seen that the forming member 10 includes four side wall sections 11, which are fastened together by corner brackets (not shown) such as known in the art. The side wall sections 11 may be of plywood or other suitable material. A wooden handle member 13 is rigidly attached relative to the side walls by wood support posts 14. As shown in FIG. 2, a group of golf balls such as 22 are shown within forming member 10 while in its "forming" orientation. In this orientation, the forming member 10 has an upwardly-directed forming cavity which is configured to accept the plurality of golf balls 22 and to encourage the golf balls into the stacked group 20 shown in FIG. 2. Such a stacked group 20 is the same as the golf ball grouping shown in FIGS. 1 and 3, except that instead of the peak of the pyramidic grouping being pointed upwardly as shown in FIGS. 1 and 3, the peak is pointed downward in the orientation shown in FIG. 2.

A stacking method according to the present invention is now described. The forming member 10 is oriented as shown in FIG. 2, with its ball-receiving cavity being directed generally upwardly. The forming member 10 may be maintained in a relatively stable state by placing the outward flat face of the handle member 13 in planar contact with a substantially horizontal supporting surface (not shown). A plurality of golf balls 22 are then placed within the upwardly-disposed cavity, such that they are situated within the forming member 20 such as shown in FIG. 2.

It should be understood that when the golf balls are being placed within the forming member 20, it may be necessary for the human operator to guide balls somewhat towards their desired locations. However, it will be understood that the forming member 20 provides the final determination as to the shape of the golf ball group.

After the golf balls 22 are situated acceptably, the human operator then places a base (such as 30 in FIG. 1) atop the golf ball group, such that the golf ball group is substantially enclosed by the forming member base combination. The forming member 20, balls 22, and base 30 are then inverted together as a group.

Upon such an inversion, a base of golf balls then is in contact with the lower base 30, with the outermost golf balls of the base (or "first") layer of balls also being laterally contained by the upwardly-projecting peripheral edge member 32. Upon withdrawal of the forming member 10, a pyramidically-shaped golf ball stack such as shown in FIG. 3 is provided (atop the base 30) for selective removal as needed.

Alternatives

It may be understood that although FIGS. 1, 2, and 3 illustrate a four-sided forming member configuration, other configurations may also be provided under the present invention. For example, three-sided, five-sided, or other multiple-sided form members may be provided under the present invention, provided they facilitate a suitably stable stacked configuration upon inversion. In each case, the number of golf balls at the apex is one and the number at the adjacent level is equal to the number of sides.

In the embodiment illustrated in FIG. 3, the uppermost level of balls in the stacked configuration is one in number. The second level is four in number (2×2). The third level includes nine golf balls (3×3). The fourth level includes 16 golf balls (4×4), and the fifth level is 25 (5×5) in number. However, it should be understood that additional levels may be included, with a preferred embodiment including several levels, with the lowermost level having 49 (7×7) balls therein.

Therefore, the number of golf balls at any given level with the invertible forming member 10 may be computed as the square of the count of levels from the apex, which is the first level having a single golf ball. Thus, the first level has $1^2$ or 1 golf ball; the second level thus $2^2$ or 4 golf balls, etc.

Figure 5:
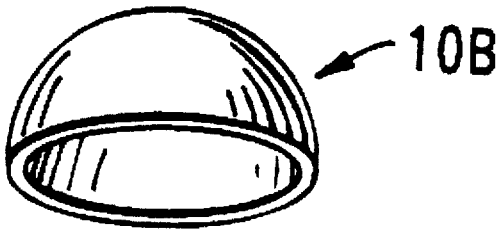
FIG. 5 illustrates an invertible stacking forming member of hemispherical shape.

In addition, the invertible forming member may be dome-shaped, such as hemispherical 10B such as shown in FIG. 5, in which case there would be a singe dome-shaped side. The stack of golf balls will then take on a dome-shape instead of geometric shapes with planar sides. In all cases, the outward facing configuration of the inverted form does not necessarily determine the shape of the stack of golf balls—the inward facing configuration is responsible.

In all embodiments, the interior facing side(s) converge(s) toward the bottom from the open top. The bottom is closed to prevent the passage of golf balls therethrough. The side(s) and base should be constructed to prevent the passage of the golf balls therethrough, whether being of a solid, closed construction or with apertures each dimensioned smaller than the size of a golf ball. In addition, the invertible stacking form 10 and the base 30 in any of the embodiments may be of any sturdy material, such as wood, plastic, metal, ceramic or any combination. Their construction should be of sufficient strength and durability to prevent the golf balls from falling out while the group as a unit is being inverted.

Although the forming member 20 embodiment shown in FIG. 2 is preferably made mostly of wood with metal fasteners, other suitable materials such as plastic, fiberglass, metal or ceramic may also be used without departing from the spirit of the scope of the present invention.

Conclusion

While this invention has been described in specific detail with reference to the disclosed embodiments, it will be understood that many variations and modifications may be effected within the spirit and scope of the invention as described in the appended claims.

What is claimed is:

1. An apparatus for stacking golf balls, comprising:

an inverted form defining an interior cavity and having an open top through which golf balls may enter into the cavity and having a bottom sufficiently closed to block passage of the golf balls, said inverted form having at least one wall that converges from the open top to the bottom to define a volume of the interior cavity that accommodates stacking of golf balls from the bottom to the open top; and a base member arranged to sufficiently close said open top to prevent passage of the golf balls therethrough, said inverted form and said base member being movable as a group together between an upright orientation with the base member having a higher elevation than said bottom of said inverted form and an inverted orientation with the base member having a lower elevation than said bottom of said inverted form, said base member in said inverted orientation supporting a stack of the golf balls in the interior cavity stably so that a subsequent removal and separation of the inverted form from the base member leaves the golf balls still stacked stably on said base member.

2. An apparatus as in claim 1, wherein said inverted form is configured so that the stacking configuration of the golf balls is determined by a configuration of the inverted form.

3. An apparatus as in claim 1, wherein the inverted form has four interior facing side walls so that the stacking configuration is pyramidal.

4. An apparatus as in claim 1, wherein the inverted form has at least three interior facing side walls.

5. An apparatus as in claim 1, wherein the inverted form has an interior facing surface that is hemispherical.

6. An apparatus as in claim 1, wherein said inverted form has an apex at the bottom and a plurality of sides that converge to said apex, said volume being dimensioned to accommodate golf balls such that at said apex there is a level with one golf ball and at an adjacent level there are a number of golf balls equal to a number of the sides.

7. An apparatus as in claim 1, wherein said inverted form has an apex at the bottom and four sides that converge to said apex said volume being dimensioned to accommodate a plurality of levels of golf balls with a first level at the apex such that a number of golf balls at a given one of the levels is determined by squaring a count of the levels from the apex to the given one of the levels.

8. An apparatus as in claim 1, further comprising posts that support said inverted form in said first orientation as golf balls are loaded into the cavity.

9. A method of stacking golf balls, comprising the steps of: stacking golf balls in levels within an interior cavity of an inverted form, the inverted form having at least one interior facing side that converges from an open top to a bottom, said bottom being closed to prevent passage of the golf balls therethrough; closing the open top with a base member; inverting as a group together, the inverted form, the stack of golf balls within the interior cavity and said base member from an upright orientation with the base member having a higher elevation than said bottom of said inverted form to an inverted orientation with the base member having a lower elevation than said bottom of said inverted form;

supporting the golf balls in a stacked configuration atop said base member as the group reaches said inverted orientation; and subsequently removing and separating the inverted form from the base member to leave the golf balls still stacked stably on said base member.

10. A method as in claim 9, wherein the inverted form has an apex at the bottom and a plurality of interior facing sides that converge to said apex, the step of stacking including stacking the golf balls in levels with a first level at the apex so that a number of golf balls at an immediately adjacent level equals a number of said sides.

11. A method as in claim 9, wherein the inverted form has an apex at the bottom and a plurality of interior facing sides that converge to said apex, the step of stacking including stacking the golf balls in levels with a first level at the apex so that a number of golf balls at a given one of the levels is equal to a square of a count of the levels from the apex to the given one of the levels.

* * * * *